US007165376B2

(12) United States Patent
Kawashima et al.

(10) Patent No.: US 7,165,376 B2
(45) Date of Patent: Jan. 23, 2007

(54) METHOD FOR PRODUCING GAS EXCHANGE PACKAGE

(75) Inventors: Masahiko Kawashima, Suzuka (JP); Gensyou Unno, Yokohama (JP); Yutaka Matsuki, Kameyama (JP)

(73) Assignee: Asahi Kasei Life & Living Corporation, Tokyo (JP)

( * ) Notice: Subject to any disclaimer, the term of this patent is extended or adjusted under 35 U.S.C. 154(b) by 0 days.

(21) Appl. No.: 10/498,053

(22) PCT Filed: Dec. 16, 2002

(86) PCT No.: PCT/JP02/13139

§ 371 (c)(1),
(2), (4) Date: Jun. 9, 2004

(87) PCT Pub. No.: WO03/053809

PCT Pub. Date: Jul. 3, 2003

(65) Prior Publication Data

US 2005/0106291 A1 May 19, 2005

(30) Foreign Application Priority Data

Dec. 20, 2001 (JP) ..... 2001-388195

(51) Int. Cl.

| | |
|---|---|
| ***B65B 51/06*** | (2006.01) |
| ***B65B 31/02*** | (2006.01) |
| ***A23B 7/148*** | (2006.01) |
| ***A23B 7/152*** | (2006.01) |
| ***B65D 81/20*** | (2006.01) |

(52) U.S. Cl. ..... 53/419; 53/432; 53/471; 53/485; 206/213.1; 426/106

(58) Field of Classification Search ..... 53/419, 53/432, 485, 137.2, 136.3, 136.4, 471; 206/213.1; 426/106

See application file for complete search history.

(56) References Cited

U.S. PATENT DOCUMENTS 2,314,527 A * 3/1943 Taylor ..... 53/432
2,747,345 A * 5/1956 Plastino ..... 53/419

(Continued)

FOREIGN PATENT DOCUMENTS

DE 3618829 A1 * 12/1987

(Continued)

*Primary Examiner*—Stephen F. Gerrity
(74) *Attorney, Agent, or Firm*—Birch, Stewart, Kolasch & Birch, LLP

(57) ABSTRACT

To provide a method of manufacturing a gas displacement package that can cope with packages with various sizes and shapes, and a sealing packaging container, and a package. A method of manufacturing a gas displacement package and a sealing packaging container, and a package, wherein a packaging container comprising a receptacle and a lid of plastic is used, ridges of the receptacle and the lid overlapped each other, the ridges are sealed with a band tape, and the container is gas displaced through a hole of the container and is sealed.

11 Claims, 17 Drawing Sheets

U.S. PATENT DOCUMENTS

| | | | | | |
|---|---|---|---|---|---|
| 3,214,221 | A | * | 10/1965 | Finnegan | 53/512 |
| 3,653,581 | A | * | 4/1972 | Ptak | 206/497 |
| 3,745,024 | A | * | 7/1973 | Ford et al. | 53/434 |
| 3,877,197 | A | * | 4/1975 | Cayton et al. | 53/434 |
| 4,548,852 | A | * | 10/1985 | Mitchell | 53/432 |
| 4,633,648 | A | * | 1/1987 | Yeung | 53/419 |
| 4,646,914 | A | * | 3/1987 | Gipson | 206/213.1 |
| 4,919,955 | A | * | 4/1990 | Mitchell | 53/432 |
| 5,447,234 | A | | 9/1995 | Faulstick et al. | |
| 5,643,625 | A | * | 7/1997 | Perry et al. | 53/432 |
| 5,866,183 | A | * | 2/1999 | Small | 53/419 |
| 6,051,263 | A | * | 4/2000 | Gorlich et al. | 53/432 |
| 6,155,027 | A | * | 12/2000 | Brooks | 53/432 |

FOREIGN PATENT DOCUMENTS

| | | | | | |
|---|---|---|---|---|---|
| JP | 55-29407 | A | | 3/1980 | |
| JP | 59-62468 | A | | 4/1984 | |
| JP | 61-103 | A | | 1/1986 | |
| JP | 2-66450 | U | | 5/1990 | |
| JP | 02191124 | A1 | * | 7/1990 | 53/419 |
| JP | 02242771 | A1 | * | 9/1990 | 206/213.1 |
| JP | 4-189721 | A | | 7/1992 | |
| JP | 6-199378 | A | | 7/1994 | |
| JP | 9-295677 | A | | 11/1997 | |
| JP | 2000-318709 | A | | 11/2000 | |
| JP | 2001-48236 | A | | 2/2001 | |

* cited by examiner

METHOD FOR PRODUCING GAS EXCHANGE PACKAGE

This application is a National Stage filing under 35 U.S.C. § 371 of International Application No. PCT/JP02/13139, which has an international filing date of Dec. 16, 2002 and which designated the United States of America.

TECHNICAL FIELD

The present invention relates to method of manufacturing a gas displacement package and a sealing packaging container and the package.

BACKGROUND ART

Hitherto, it is general that individual households buy foodstuff and cook them to eat. Recently, however, for the intention of effecting housework simply, life style is increased in which households buy food products, which are previously cooked in a food processing room or a central kitchen of a supermarket or the like, at supermarkets or convenience stores to eat at home. In the cooked food field, developments of not only contents but also packages with various sizes or shapes have been greatly effected in order to provide best displays by changing shapes and designs of the packages.

Especially, in a deli field, unlike a conventional sales manner in which one kind of food product is sold in large quantity, food products cooked by many cooking methods are divided into small portions for more variation and sold so that consumers can choose the products as desired. Thus, for clerks of delis at supermarkets or convenience stores, it becomes a problem that cumbersome and complication required for changing devices at the time of packaging various kinds of food products in small quantity, reduction in production efficiency caused by the complicated changing, and complicated control of packaging machine parts for respective packages for various kinds of food products in small quantity.

On the other hand, it is in trend that cooked food products in which original flavors of ingredients are utilized are desired, but food products with reduced food additives soon become rotten and have short product cycles. This causes problems of need of many hands or reduction in a yield of food processing.

As a method of preserving products for a long period, gas displacement packaging is known that preserves food products under an inert gas atmosphere to increase a distance of product distribution, reduce products that have fallen out of date, and increase production efficiency. As an example of such gas displacement packaging, JP-A-9-295677 discloses a gas filling packaging method in which a gas filling packaging tray is used that includes a tray on which a substance is placed and a lid that covers the tray, the lid having a gas blow-in inlet on a top thereof and a gas outlet therearound, to cover the entire tray with a heat-shrinkable film having a gas barrier property. This method allows gas to be blown in through the gas inlet and exhausted through the outlet around the lid, thus allowing air remaining in the tray covered by the lid to be displaced by gas.

JP-A-4-189721 discloses a method in which there is provided an insulating base plate having a heating element at an edge of a hole opened in a plate, a container is placed with a flange of the container applied to the heating element, and then filled with contents, subjected to gas displacement in a vacuum chamber, and covered with a lid, and after conveyed by a conveyer, a pressing plate is lowered from above the container to perform heat bonding of the container and the lid with a die of a heated seal device.

Further, JP-A-61-103 discloses a method in which a container made of a synthetic resin sheet is filled with contents, an opening of the container is covered with a sealing film or sheet, and then the entire opening of the container is thermally pressed from an upper surface of the sealing film or sheet by a heat roll to thermally bond a periphery of the opening.

However, the method represented by JP-A-9-295677 is a method in which the gas is simply flushed into the package through the gas blow-in inlet at the top of the lid, and the air is exhausted through the gas outlet, thus a rate of displacement when the gas displaces the air in a space in the package is low, and depending on shapes of the contents, oxygen contained in the contents cannot be sometimes displaced by the displacement gas. The entire package is covered with the heat-shrinkable film having the gas barrier property, thus cutouts of the gas blow-in inlet at the top of the lid or the gas outlet tend to break the film to cause leakage of the filled gas. Besides, because of double packaging of the container and the film, the number of packaging materials are lot, causing a problem of increase in entrepreneur's bearing of cost based on the Container and Package Recycling Law.

On the other hand, the gas displacement method disclosed in JP-A-4-189721 requires the heat element corresponding to each of various containers with different sizes or designs. This requires a seal die resistant to pressure that accommodates changes in atmospheric pressure in the chamber, and such a dedicated seal die for each container is expensive to manufacture.

The method disclosed in JP-A-61-103 causes thermal deformation of the sealing film or sheet when the sealing film or sheet is thermally pressed on the opening of the container by the heat roll. When the content protrudes beyond the depth of the container, there are problems that the content is pressed by the top film, or the films overlap to each other at flange of the container to make wrinkles and cause foreign matters to be mixed into through clearances. In addition, like the above described example, this method has a problem that, for containers with different shapes, heating dies corresponding to the shapes have to be provided.

The present invention has an object to provide a method of manufacturing a gas displacement package and a sealing package that allows air in a space and a content in the package to be displaced by gas at a high rate of displacement, complies with the Container and Package Recycling Law, and facilitates changes in shapes and sizes of the package.

DISCLOSURE OF THE INVENTION

A method of manufacturing a gas displacement package according to the present invention is characterized in that a container comprises a receptacle and a lid, the receptacle and the lid are overlapped each other at respective edge portions to cover a top of the receptacle, the overlapped portions are sealed with a band tape, the container has a hole, air in the container is expelled through the hole and displaced by gas other than air, and then the hole is sealingly closed.

It is preferable that the container is made of plastic.

It is preferable that the container, the band tape and an adhesive label have a gas barrier property.

It is preferable that the receptacle and the lid have at their edge portions flanges including horizontal portions horizontally extending from openings, substantial vertical portions vertically extending from ends of the horizontal portions, and ridges at boundaries between the horizontal and vertical portions, and among the vertical portions of the flanges, the vertical portion located inside with respect to the container is longer than the vertical portion located outside with respect to the container, the inside vertical portion has a step at a portion in contact with an end of the outside vertical portion, and the band tape is adhered over the step for sealing.

It is preferable that the hole for gas displacement is provided on a top surface of the lid.

It is preferable that the vertical portions of the flanges vertically extend downwards from the horizontal portions.

A packaging container according to the present invention is characterized in that a receptacle and a lid have at their edge portions flanges including horizontal portions horizontally extending from openings, and substantial vertical surfaces vertically extending from ends of the horizontal portions, and among the flanges, the vertical portion located inside with respect to the container is longer than the vertical portion located outside with respect to the container, and the inside vertical portion has a step at a portion in contact with an end of the outside vertical portion.

A ridge of the lid and/or the ridge of the receptacle may have recesses formed in such a manner that the vertical portion is dented inwardly and the horizontal portion is dented downwardly.

The packaging container may have a reinforcing surface that extends outwardly and horizontally from the end of the inside vertical portion.

The present invention provides also a package obtained by the above-described method of manufacturing a gas displacement package.

BRIEF DESCRIPTION OF THE DRAWINGS

FIGS. 4*a* and 4*b* show a flange of a receptacle in FIG. 1, in which FIG. 4*a* is a plan view and FIG. 4*b* is a front view.

FIGS. 5*a*, 5*b* and 5*c* illustrate recess shapes in a horizontal portion and a vertical portion shown in FIGS. 4*a* and 4*b*, in which FIG. 5*a* shows a triangle in the horizontal portion, FIG. 5*b* shows a semicircle or a semi-ellipse in the horizontal portion, and FIG. 5*c* shows a trapezoid in the horizontal portion.

FIG. 16*a* is a perspective view in which the band tape with the cutout is used, and sealing has been completed, FIG. 16*b* is a perspective view in which the ends of the band tape are being pulled to cause cutting at the cutout of the band tape for unsealing, and FIG. 16*c* is a schematic diagram of the ends of the band tape in FIG. 16*a*, seen from the above. FIG. 17*a* is a perspective view in which the band tape with the cut tape in parallel with the length is used, and sealing has been completed, and FIG. 17*b* is a perspective view in which an end of the cut tape of the band tape is being pulled to separate the band tape into two at the center by the cut tape (upper and lower sides of the separated band tape are still attached to the receptacle and the lid) for unsealing the container.

BEST MODE FOR CARRYING OUT THE INVENTION

Now, preferred embodiments of the present invention will be described in detail. First, a container used in the present invention will be described.

The container of the present invention includes a receptacle and a lid, which may be made of any materials. For example, the materials may include plastic, metal, wood, paper, etc. alone, or lamination of such materials. The lid of the present invention is shaped to cover a top of the receptacle, and may be made of the same materials as the receptacle. In particular, plastic is preferable because it is clear and allows a content to be visible, has a high gloss, a good appearance, and a good fractional recovery system in disposing of. A gas barrier plastic described later is more preferable in view of preventing gas dispersion. In order to display the container such that it looks as if it contains a large volume of content, it is preferable to form the receptacle to have a smaller height than the lid covering the top. A shape of an opening of the receptacle according to the present invention may be a circle, a polygon such as a triangle, a box (rectangle, square), or a rhombus, or an indefinite shape such as an ellipse, or a curve.

The container is used in such a manner that it is sealed with the band tape, that is, the band tape is adhered over both edges of the receptacle and the lid.

An overlapping portions of the receptacle and the lid of the present invention means a portion at which edges of the openings of the receptacle and the lid overlap each other to close. The shapes of the edges may be linear or curved, or may be along or not along the shape of the receptacle as long as both edges can overlap each other to close. The overlapping portion is not necessarily provided at the entire edges as long as the container can be sealed when the band tape is adhered, but is preferably provided at an entire periphery. Parts of the receptacle and the lid may be joined via a hinge.

In order to efficiently and mechanically perform sealing, and to keep stiffness of the container, it is preferable that the overlapping portion has flanges and they are shapes to be overlapped at the flanges. With the flanges, attaching the band tape to ends of the flanges, that is, ends of vertical portions easily provides a stable seal.

Figure 1:
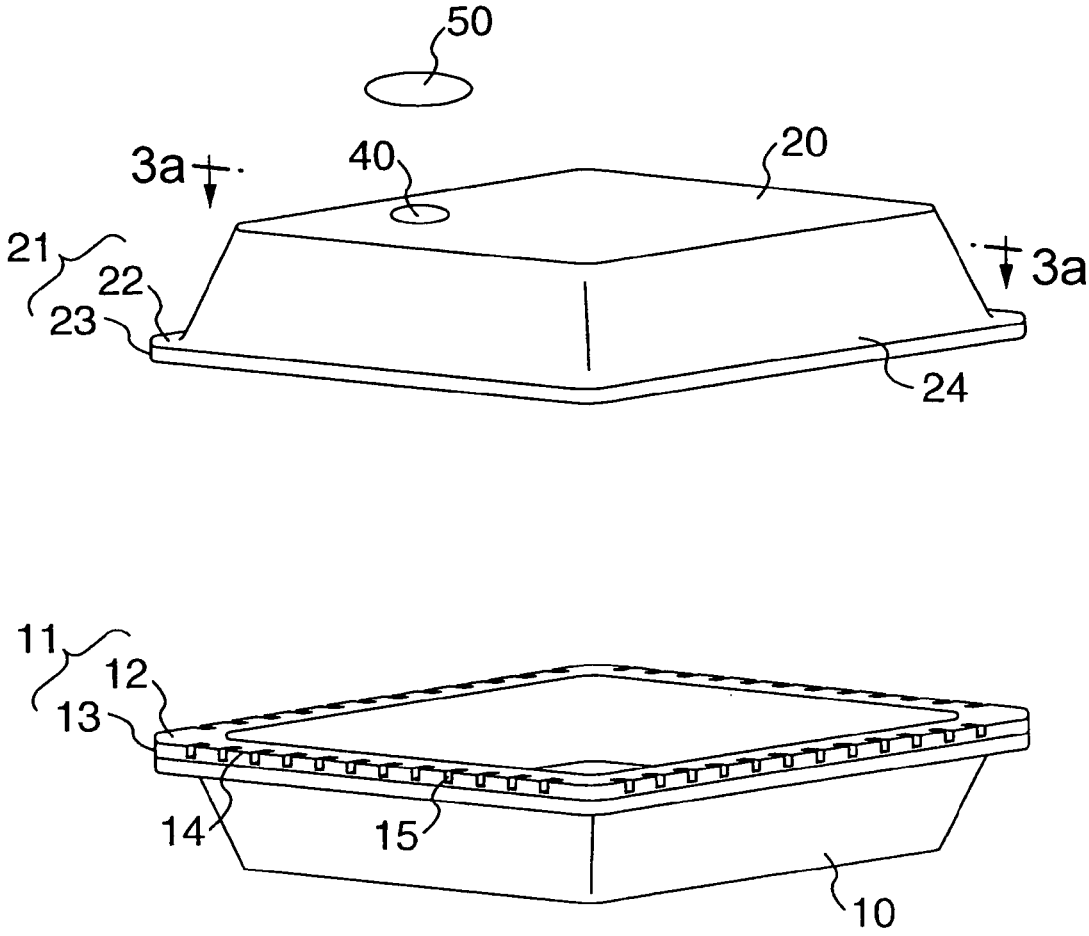
FIG. 1 is a perspective view of a container and a lid.

The flanges refer to entire portions extending from the edges of the openings of the receptacle and the lid, and correspond to brim portions at which the receptacle and the lid overlap each other (for example, reference numeral 11 and 21 in FIG. 1). The flanges comprise horizontal portions (reference numeral 12 and 22 in FIG. 1), vertical portions (reference numeral 13 and 23 in FIG. 1), and ridges at boundaries between the horizontal and vertical portions (reference numeral 14 and 24 in FIG. 1).

The horizontal portions are surfaces substantially horizontally extending from the edges of the openings of the receptacle and the lid. The horizontal portions may be tilted or have slight variations in thicknesses of materials as long as they are substantially horizontal.

The vertical portions (reference numeral 13 and 23 in FIG. 1) are surfaces substantially vertically extending from the horizontal portions. The vertical portions may be tilted as long as they are substantially vertical. The direction of the extending may be upwardly or downwardly from the horizontal portion, or the vertical portion of the lid may be extended upwardly and the vertical portion of the receptacle may be extended downwardly. It is preferable, however, both the vertical portions of the receptacle and the lid extend downwardly because with such structure, dust and litter hardly enter from the overlapped portions.

As described above, providing the flange with the vertical portion allows the band tape to be stably attached to the vertical portion even when mechanically attached using an attachment device etc. At this time, it is preferable to provide a difference between lengths of the vertical portions of the lid and the receptacle because the band tape can be attached over both ends of the flanges and attached even to corners of the container without wrinkles. Especially, when an attachment device that operates at high speeds is used for attaching, it is effective that the vertical portion which is inside the container is longer than the vertical portion which is outside the container. Specifically, when the vertical portions are extended downwardly from the horizontal portions, the vertical portion of the receptacle is formed to be longer than the vertical portion of the lid, while when the vertical portions are extended upwardly from the horizontal portions, the vertical portion of the lid is formed to be longer than the vertical portion of the receptacle. This shape of the container causes no wrinkles of the band tape at the corners of the container, and no reduction in sealing performance. When sealing is carried out by using a packaging device, even if shape or size of the container is changed, it is possible to cope with such change only by changing the width of the band tape or attaching position of the band tape set in the packaging device, thus eliminating the need for providing sealing parts for each container.

Further, when the longer vertical portion is provided with a step (reference numeral 81 in FIG. 6) having a depth enough to accommodate a thickness of the shorter vertical portion, the vertical portions become flat to allow the band tape to be attached in a flat manner, thus facilitating work, increasing strength as a package, and facilitating handling of the package.

The vertical portion may have a length such that the band tape can be attached over the portion, and the length is not limited, but is preferably 2 mm to 35 mm because the lid and the receptacle are not easily displaced when the tape is attached, thus facilitating attachment of the tape, increasing stiffness of the flange, and improving the appearance. The length is more preferably 3 mm to 30 mm, and further preferably 4 mm to 25 mm.

If the vertical portions of the receptacle and the lid are extended in opposite directions, it is preferable to provide a recess or a projection for positioning at the flange. Any locations or sizes may be possible as long as the receptacle and the lid are not displaced when the band tape is attached to the boundary between the lid and the receptacle. The recess or the projection is preferably provided near the opening of the container, especially at corners inside the receptacle in view of appearance or ease of taking out the content. It is also preferable to provide a recess at the horizontal portion of the receptacle and a projection at the horizontal portion of the lid.

Further, it is preferable to form a recess (reference numeral 15 in FIG. 1) at the flange in order to increase strength of the flange. This eliminates the possibility of deformation of the flange by an external force applied when the band tape is attached, and prevents reduction in the appearance or sealing performance caused by the deformation.

Further, the flange may have a fitting thread. The fitting thread means a shape having grooves for fitting the receptacle to the lid at the ridges of the receptacle and the lid. The providing manner of the fitting thread is roughly divided into three kinds: outer fitting, inner fitting, and inner and outer fitting. The outer fitting is a structure not requiring high accuracy of a mold for forming the container, and is inexpensive and easy. On the other hand, the inner fitting requires higher accuracy of the mold in forming the container in comparison with the outer fitting, and is expensive, but when the content is deli substances containing juice, it can prevent leakage of the juice out of the container. Further, the inner and outer fitting requires high accuracy of the mold in forming the container, and is very expensive, but is the highest level fitting that provides high fitting strength at a fitting portion and prevents separation of the lid from the receptacle even when some impact is applied.

The packaging container has a hole. The hole has to be a channel through which gas flows into and out of the packaging container which the receptacle and the lid are sealed, and is different from a clearance between a receptacle and a lid in a prior art gas displacement method using a chamber. A size or a shape of the hole, or the number of holes may be such that the gas can flow into and out of the packaging container. The hole is preferably provided on the lid in view of ease of closing the hole after the gas displacement or preventing leakage of the content, and more preferably on the top of the lid.

An opening area of the hole is preferably 0.3 to 3 $cm^2$ with respect to a volume of the content of 1000 $cm^3$ in the packaging container.

Figure 8:
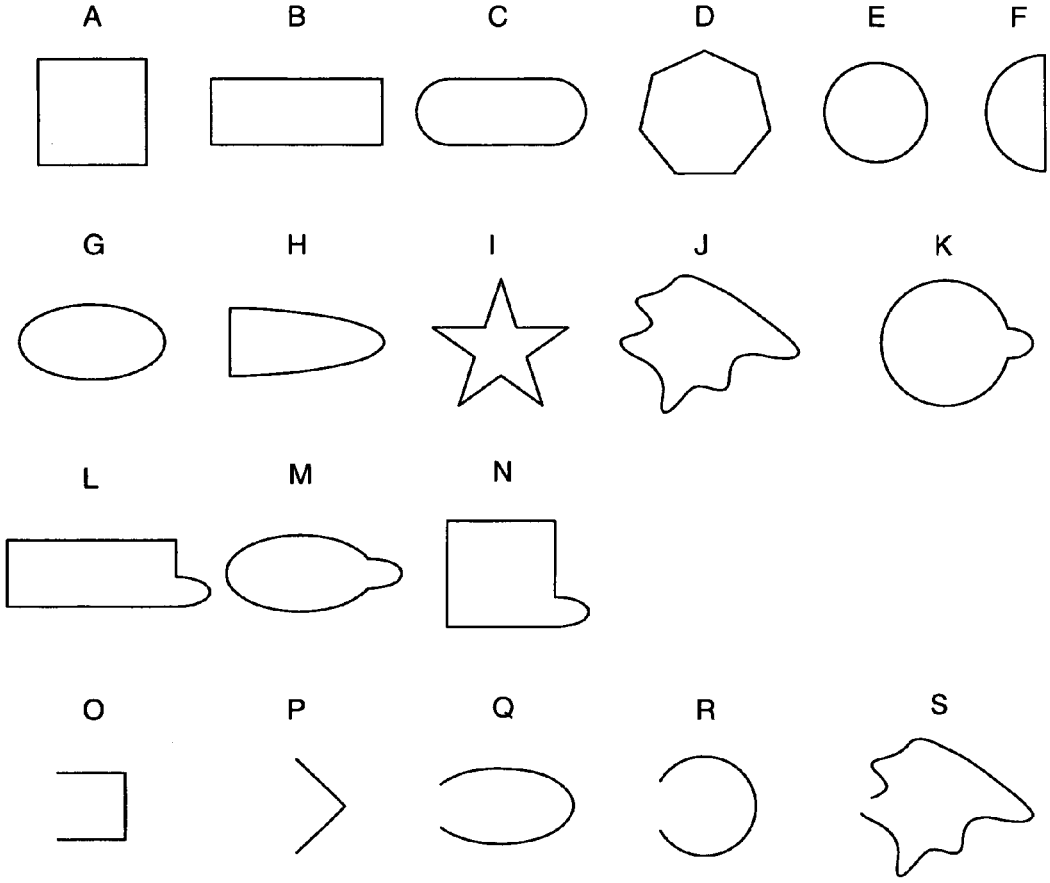
FIG. 8 shows examples of shapes of a hole and an adhesive label.

The opening shape of the hole may be such that the gas can flow into and out of the packaging container. For example, the opening shapes of the hole may include a cutout shape having a complete opening such as a square (A in FIG. 8), a rectangle (B in FIG. 8), a rounded rectangle (C in FIG. 8), a polygon (D in FIG. 8), a circle (E in FIG. 8), a semi-circle (F in FIG. 8), an ellipse (G in FIG. 8), a semi-ellipse (H in FIG. 8), a star (I in FIG. 8), and an indefinite shape (J in FIG. 8), or a cutout shape having an incomplete opening such as a quasi-horseshoe shape (O in FIG. 8), a V shape (P in FIG. 8), a U shape (Q in FIG. 8), a C shape (R in FIG. 8), and an indefinite shape (S in FIG. 8). These cutout shapes are preferable because they cause no cuttings in boring the hole in the lid.

An area of the cutout hole is represented by the largest area when a tongue in the cutout is folded to open the hole. The opening area of the hole differs depending on the volumes of the contents. However, if the opening area of the hole is 0.3 $cm^2$ smaller with respect to the volume of the content of 1000 $cm^3$ in the packaging container, resistance when air or the desired gas flows in or out of the packaging container through the hole becomes large because a large amount of gas moves in and out of the packaging container in a short time when the chamber is deaerated or the packaging container is filled with a desired gas. Due to such resistance, a difference in atmospheric pressure between the inside and the outside of the packaging container is resulted and sometimes deformation of the packaging container occurs.

If an opening area of the hole goes over 3 $cm^2$, the deaeration and the gas displacement can be performed easily, but it is needed to enlarge an area of the adhesive label for closing the hole. This sometimes compromises the appearance of the packaging container, and reduces mechanical strength of the opening of the adhesive label attached over the hole. Thus, the opening area of the hole is preferably 0.3 to 3 $cm^2$, more preferably 0.4 to 2.8 $cm^2$, and further preferably 0.6 to 2.5 $cm^2$.

The number of holes is preferably as small as possible such that the holes are closed by one adhesive label, in view of ease of closing the holes and appearance of the packaging container. However, even in a case where a large number of holes are provided, by collectively providing a plurality of small holes at one place, it is possible to close the small holes by one adhesive label, so that mechanical strength of the adhesive label is increased. Accordingly, this is preferable.

Usually, the hole is created in a different process from the forming, and an example of creating the hole will be described. First, a plastic sheet is thermally molten, and formed in conformity with a mold, and sheet-like continuous formed products are pressed and cut out by a cutting blade called a cutting die.

As a methods of closing the hole, various methods such as attaching the adhesive label or filling the hole can be considered, but closing the hole by the adhesive label is preferable in view of the appearance of the container and convenience. More preferably, a print may be made on the adhesive label for product differentiation. Materials for the adhesive label will be described later.

Now, the present invention will be described below with reference to the drawings.

FIG. 1 shows a perspective view of an embodiment of a packaging container according to the present invention. In the drawing, reference numeral 10 denotes a receptacle; 11, flange; 12, horizontal portion; 13, vertical portion; 14, ridge; 15, recess; 20, lid; 21, flange; 22, horizontal portion; 23, vertical portion; 24, ridge; 40, hole; and 50, adhesive label.

Figure 2:
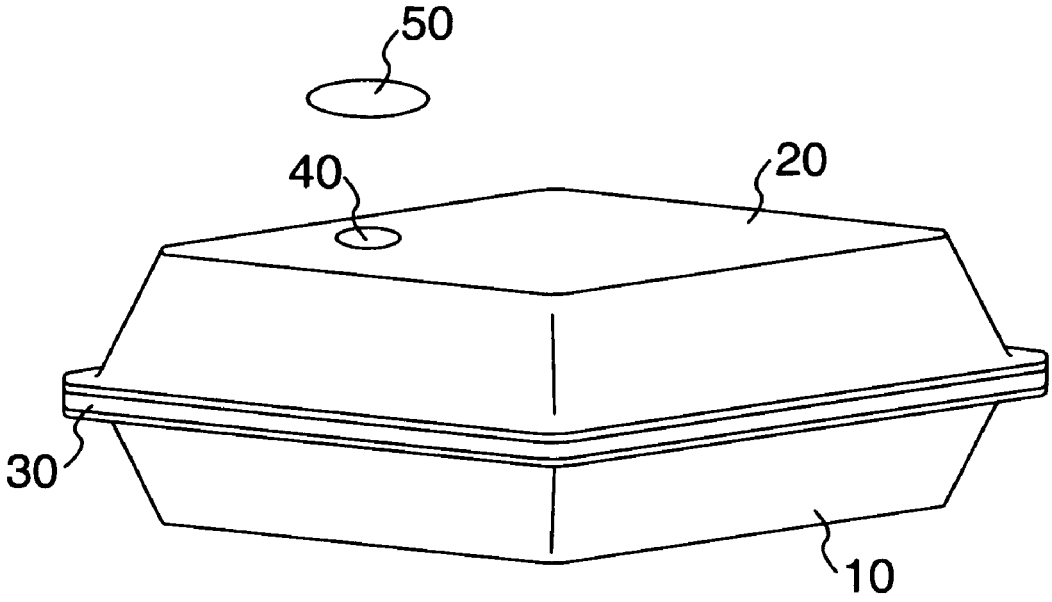
FIG. 2 is a perspective view of the container and the lid overlapped each other.

The packaging container comprises the receptacle 10 and the lid 20, and the receptacle 10 has the flange 11 at an opening, and the lid 20 has the flange 21 that is overlapped on the flange 11. FIG. 2 is a perspective view showing a state in which a content is put in the receptacle 10 of the packaging container, the lid 20 is placed on the receptacle 10, and the vertical portions are sealed with a band tape. In the drawing, reference numeral 30 denotes the band tape; 40, hole; and 50, adhesive label.

The flange 11 of the receptacle 10 has the horizontal portion 12 horizontally extending from a periphery of the opening of the receptacle 10, and the vertical portion 13 vertically extending from an end of the horizontal portion 12. The flange 21 has the horizontal portion 22 and the vertical portion 23 correspondingly to the flange 11. The receptacle has, at part of the ridge 14, the recess 15 formed in such a manner that the vertical portion 13 is dented inwardly and the horizontal portion 12 is dented downwardly. Likewise, a recess may be formed on the flange 21 of the lid in such a manner that the vertical portion 23 is dented inwardly and the horizontal portion 22 is dented upwardly at the ridge 24 formed by the horizontal portion 22 and the vertical portion 23. The recess 15 is provided in order to increase stiffness of the flange 11, and may be provided at a portion other than corners of the flange, but may be provided on the corners as desired. The number of recesses 15 is not limited.

Figure 3A:
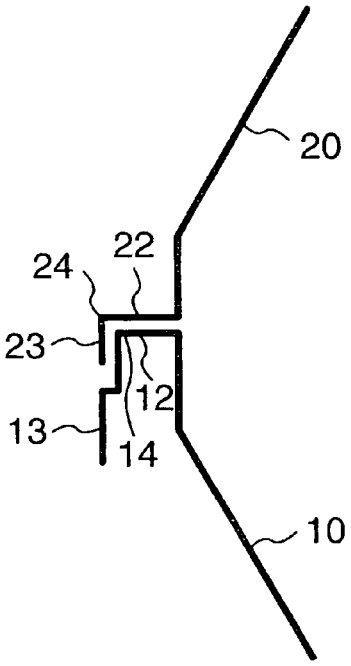
FIGS. 3*a* and 3*b* are sectional views of the container and the lid overlapped each other.
Figure 3B:
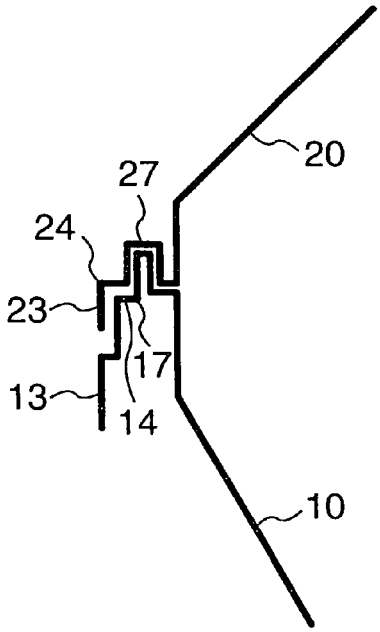

FIGS. 3*a* and 3*b* show examples of the flanges 11, 21. FIG. 3*a* is a partial enlarged sectional view taken along a line 3*a*—3*a* in FIG. 1, and shows an example in which the vertical portions 13, 23 are vertically and downwardly extended from the ends of the horizontal portions 12, 22. In this configuration, the vertical portion 13 of the receptacle 10 placed inside is formed to be longer than the vertical portion 23 of the lid 20. FIG. 3*b* shows an example in which the above described inner and outer fitting is provided in the example of FIG. 3*a*. A protrusion 17 and a groove 27 fitting over the protrusion 17 are formed in the horizontal portions 12, 22 of the receptacle 10 and the lid 20 in parallel to the peripheries of the openings to strengthen the flanges 11, 21.

Figure 4A:
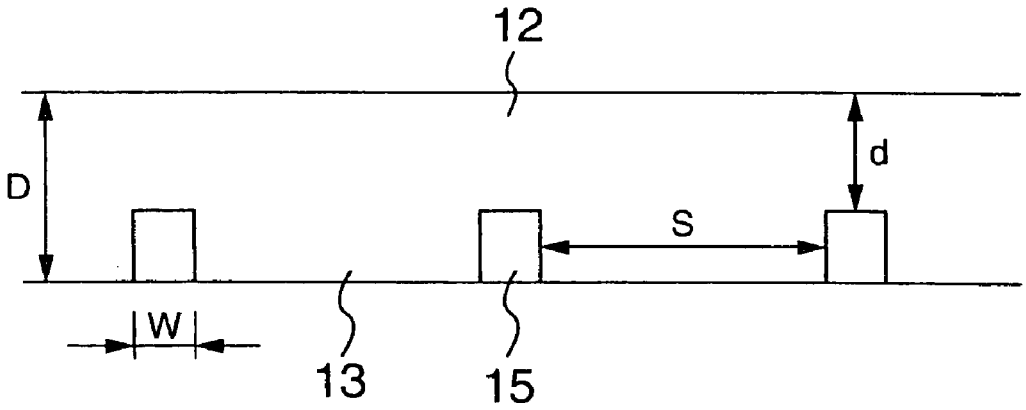
Figure 4B:
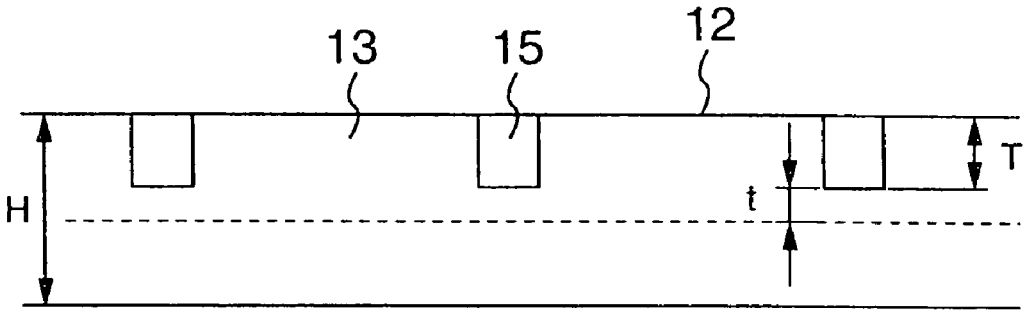

FIGS. 4*a* and 4*b* are enlarged views of the flange 11 of the receptacle 10 shown in FIG. 1. FIG. 4*a* is a plan view of the flange (a top view of the horizontal portion), and FIG. 4*b* is a front view of the flange (a front view of the vertical portion). The dotted line in the front view of FIG. 4*b* indicates a position to which the vertical portion of the lid overlaps.

A size of the recess 15 depends on a size or strength of the flange 11, but when in general the receptacle is used as a packaging container for food products, it is preferable that the recess 15 may be a rectangle in the horizontal portion 12 and the vertical portion 13 as shown in FIGS. 4*a* and 4*b*. In this case, it is preferable that a width (W) of the recess 15 is 1 to 20 mm, a distance (S) between adjacent recesses 15 is 3 to 20 mm, and a depth from the vertical portion 13 is set such that a clearance (d) remaining in a width (D) of the horizontal portion 12 is 1 mm or more and ⅕ to ⅘ of the width (D). A depth (T) from the horizontal portion 12 is set such that a clearance (t) between the recess 15 and the end of the vertical portion 23 of the flange 21 of the lid 20 indicated by the dotted line is 0.5 mm or more and ½ or less of a width (H) of the vertical portion 13. A relationship between a width (H) of the vertical portion 13 and the depth (T) is set such that (H-T) leaves an enough width to attach the band tape. When the recess 15 is provided on the flange 21 of the lid 20, in the above-described setting, the term "flange 11" may by replaced by the term "flange 21".

Figure 5A:
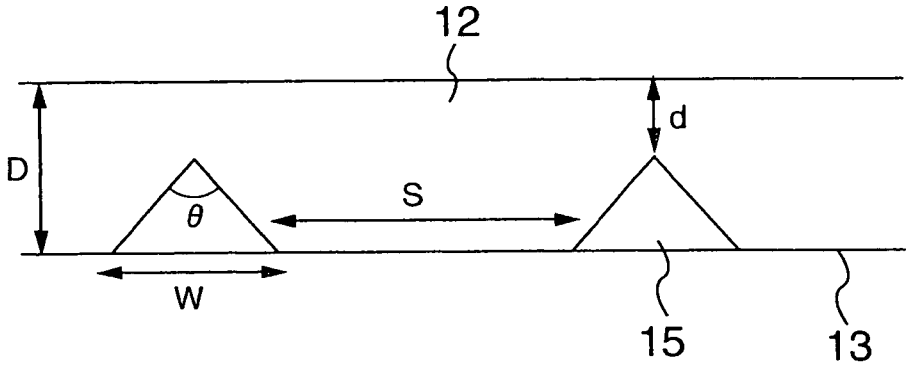
Figure 5B:
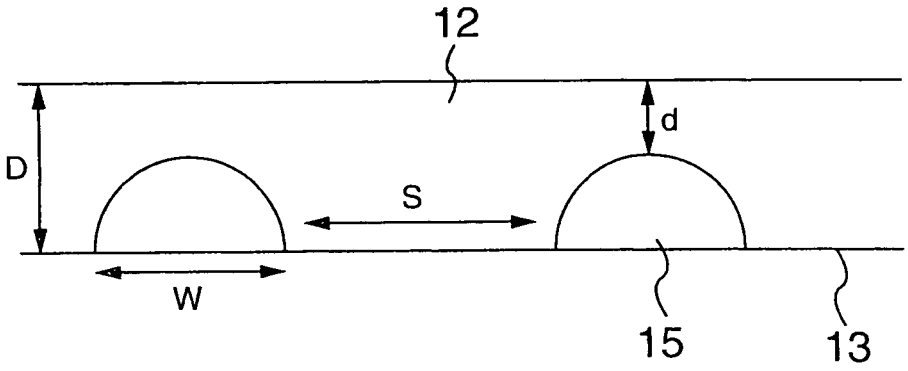
Figure 5C:
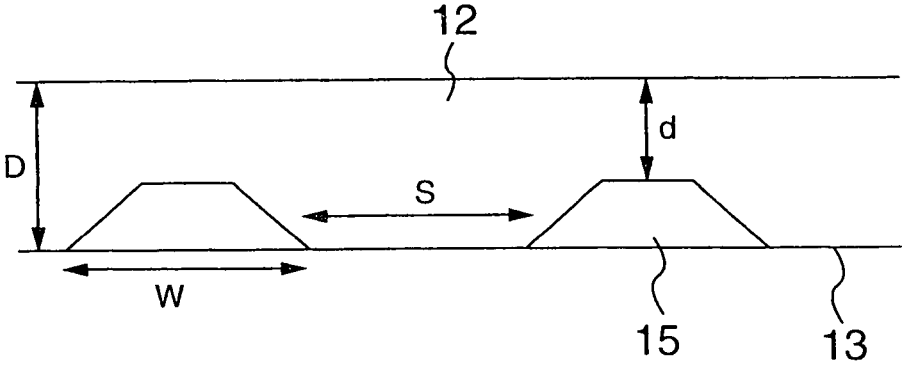

The shape of the recess 15 may be, besides the rectangles in the horizontal portion 12 and the vertical portion 13 as shown in FIGS. 1, 4*a* and 4*b*, a triangle as shown in FIG. 5*a*, a semi-circle or a semi-ellipse as shown in FIG. 5*b*, or a trapezoid as shown in FIG. 5*c* in the horizontal portion 12.

In addition, in the case shown in FIG. 5*a*, a top angle (θ) in the horizontal portion 12 is preferably 20 to 150°, and in the case shown in FIG. 5*c*, a width (w) of a top side is preferably 1 to 18 mm. In either case, it is preferable that a depth from the vertical portion 13 is set such that a clearance (d) remaining in the width (D) of the horizontal portion 12 is 1 mm or more and ⅕ to ⅘ of the width (D). Further, a width (W) in the vertical portion 13, a distance (S) between the adjacent recesses 15, and a depth from the horizontal portion 12 are the same as in the rectangle shown in FIG. 4*a*.

In the packaging container, in order to prevent the lid 20 from slipping off the receptacle 10, one of the flanges 11, 21 of the receptacle 10 and the lid 20 may have a protrusion extending toward the other, and the other of the flanges 11, 21 may have a recess receiving the protrusion.

Figure 6:
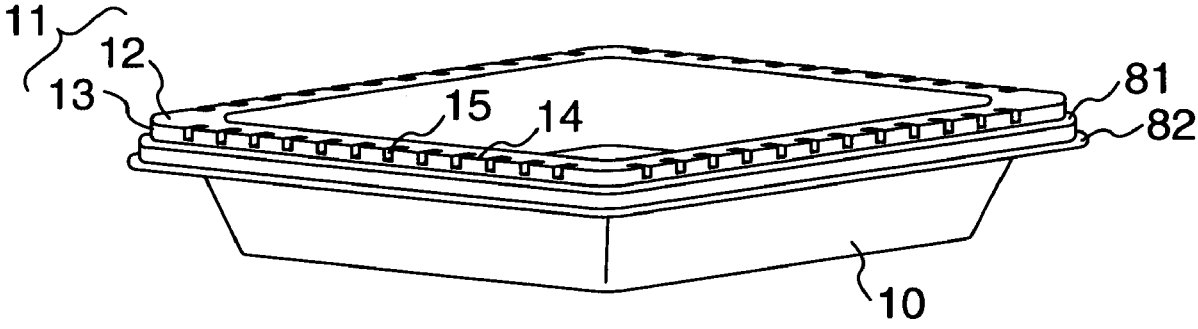
FIG. 6 is a perspective view of a configuration example with a step and a reinforcing surface formed in a configuration shown in FIG. 3*a*.
Figure 7:
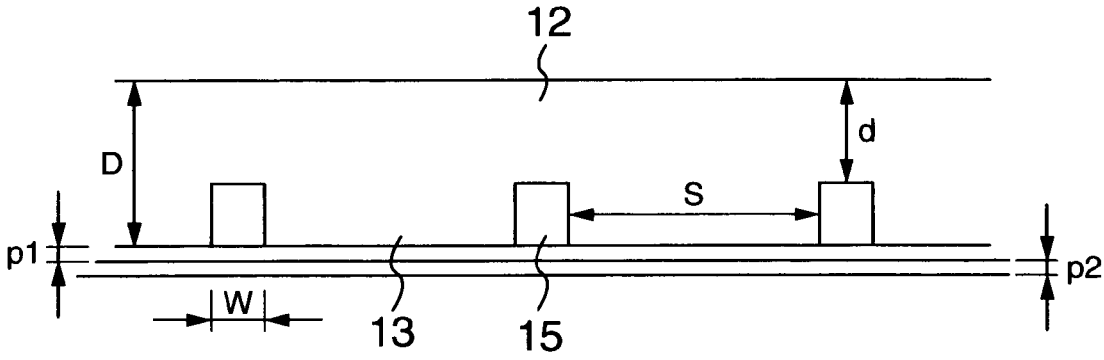
FIG. 7 is a plan view of a part of the flange of the receptacle shown in FIG. 6.

FIG. 6 shows an application example of the receptacle shown in FIGS. 3*a* and 3*b*, in which a step 81 extending outwardly in a horizontal direction is formed on the vertical portion 13 at a position below the end of the vertical portion 23, and a reinforcing surface 82 extending outwardly in the horizontal direction from the end of the vertical portion 13 is formed. FIG. 7 is a partial plan view of the flange of the receptacle shown in FIG. 6. A width (p1) of the step 81 is preferably within ±2 mm of a thickness of the vertical portion 13 of the flange 11 of the lid 20. By providing the step 81, a step, which is formed on a surface of the band tape by the end of the vertical portion 23 when the band tape is attached, is made to be gentler, thus improving the appearance. The step 81 is preferably placed near the vertical portion 23 of the lid 20, and more preferably within 2 mm from the end of the vertical portion 23. A width (p2) of the reinforcing surface 82 is preferably set within 1 to 2 mm because a width less than 0.5 mm insufficiently increases the stiffness, and a width more than 2 mm compromises the appearance.

It is preferable that when the receptacle and the lid of the present invention are made of thermoplastic resin, a resin sheet previously created is formed by a known thermoforming method (such as air pressure forming, vacuum forming, vacuum air pressure forming).

When the receptacle and the lid are formed from the resin sheet, any resins that are generally used for receptacle and lids may be used. For example, thermoplastic resins include a polyethylene resin, a polypropylene resin, a polystyrene resin, a methacrylate resin, a polyvinyl chloride resin, a polycarbonate resin, a cellulose acetate resin, and the like. When a gas barrier property is required, thermoplastic resins include a polyamide resin, a polyethylene terephthalate resin, a polybutylene terephthalate resin, an ethylene-vinyl alcohol copolymer resin (EVOH), and the like. The receptacle and the lid are made of a single layer sheet or a multilayer sheet made of such resins. Methods for forming a multilayer include coextruding, various kinds of laminating, etc. and may be appropriately selected.

The sheet used in the present invention may be made of a material having the gas barrier property in accordance with need.

The band tape in the present invention will now be described. The band tape in the present invention is a shape elongated with a width, and can seal the packaging container by being attached over flange surfaces extending from the receptacle and the lid. The band tape has an adhesive on a surface to be brought into contact with the packaging container. As long as the receptacle and the lid can be sealed without any clearances (tightly sealed) by the adhesive, the band tape may have a constant width or a varying width.

Materials for the band tape may include a single layer or a multilayer of paper, metal thin films, and resin, but materials including metal such as a metal thin film or a metallized film are not preferable in view of preventing spark caused by electron collision in heating by a microwave oven, and the same material as the packaging container is preferable in view of fractional recovery. A gas barrier resin is further preferable in order to prevent gas dispersion from the clearance between the lid and the receptacle.

The gas barrier band tape may be made of, for example, two layers of a gas barrier base layer and an adhesive layer.

The gas barrier base layer may be provided with a gas barrier resin or a resin layer having a laminated inorganic substance. As the resin layer having a laminated inorganic substance, for example, a resin layer can be considered in which an inorganic substance of silica and/or alumina is vapor deposited on a low density polyethylene resin layer, of which gas barrier property is poor, to provide gas barrier properties.

The gas barrier base layer preferably has an amount of transmission of carbon dioxide gas of 1.0 to 4935.0 ml/m$^2$/day MPa, an amount of transmission of oxygen gas of 1.0 to 3948.0 ml/m$^2$/day/MPa, and an amount of transmission of nitrogen gas of 1.0 to 1480.5 ml/m$^2$/day/MPa, more preferably has an amount of transmission of carbon dioxide gas of 10.0 to 4500.0 ml/m$^2$/day MPa, an amount of transmission of oxygen gas of 10.0 to 2500.0 ml/m$^2$/day/MPa, and an amount of transmission of nitrogen gas of 10.0 to 1300.0 ml/m$^2$/day/MPa, and further preferably has an amount of transmission of carbon dioxide gas of 20.0 to 4000.0 ml/m$^2$/day MPa, an amount of transmission of oxygen gas of 20.0 to 1300.0 ml/m$^2$/day/MPa, and an amount of transmission of nitrogen gas of 20.0 to 1000.0 ml/m$^2$/day/MPa. More preferably, the gas barrier base layer has an amount of transmission of carbon dioxide gas of 20.0 to 1000.0 ml/m$^2$/day MPa, an amount of transmission of oxygen gas of 20.0 to 300.0 ml/m$^2$/day/MPa, and an amount of transmission of nitrogen gas of 20.0 to 250.0 ml/m$^2$/day/MPa.

The gas barrier base layer resin preferably has an amount of transmission of oxygen gas of 1.0 to 1974.0 ml/m$^2$/day/MPa. Gas barrier base layer resins may include, for example, a single layer or a multilayer of a resin compound that is composed exclusively of at least one of the followings: a polyolefin resin (PO) such as a polyethylene resin (HDPE, LLDPE, etc.), a polypropylene resin (PP), a polybutene-1 resin (PB), and a poly-4-methylpentene-1 resin; a polyolefin modified resin (PO modified resin) such as an ethylene-vinyl acetate copolymer resin (EVA), an ethylene-methyl methacrylate copolymer resin (EMA etc.), an ethylene-vinyl alcohol copolymer resin (EVOH etc.); a polyester resin (PEST) containing in part an aromatic component such as a polyethylene terephthalate (including modification) resin (PET etc.), or a polybutylene terephthalate (including modification) resin (PBT etc.), or containing an aliphatic component such as a polylactic acid resin, or a polyglycol acid resin; a chlorine resin such as a polyvinylidene chloride resin (PVDC), or a polyvinyl chloride resin (PVC); an alpha olefin-carbon monoxide copolymer resin (including a hydrogenated resin thereof); an alpha olefin (ethylene etc.)-styrene copolymer resin (including a hydrogenated resin thereof); an ethylene-cyclic hydrocarbon compound copolymer resin (including a hydrogenated resin thereof); a polyamide resin (Ny); and a caprolactone resin, or lamination of resins different from the layers, or a drawn or undrawn tape made of these resins. In particular, the polyester resin (PEST) containing in part the aromatic component such as the polyethylene resin (especially HDPE), the polypropylene resin (PP), the ethylene-vinyl alcohol copolymer resin (EVOH etc.), the polyamide resin (Ny), the polyethylene terephthalate (including modification) resin (PET etc.), or the polybutylene terephthalate (including modification) resin (PBT etc.), or containing the aliphatic component such as the polylactic acid resin, or the polyglycol acid resin are preferable in view of heat resistance and the gas barrier property. Known additives, for example, an antioxidant, a light stabilizer, an antistatic agent, an anti-fogging agent, a coloring agent, or a lubricant may be mixed, or known surface treatments, for example, a corona discharge treatment, a flame treatment, an irradiation treatment of electron and plasma, an ion etching treatment, or a gas barrier coating treatment of vinylidene chloride etc. may be performed.

The thickness of the gas barrier base layer differs depending on amounts of transmission of oxygen gas of the resin to be used, and a preferable thickness is such that the amount of transmission of oxygen gas is 1.0 to 1974.0 ml/m$^2$/day/MPa. For example, in the case of the ethylene-vinyl alcohol copolymer resin (EVOH) that has a small amount of transmission of oxygen gas, a required amount of transmission of oxygen gas can be reached in some μm in view of the amount of transmission of oxygen gas, but the resin has low stiffness as the band tape, thus may be laminated with other resins having stiffness. Such resins include, for example, the polypropylene resin (PP). For the gas barrier base layer made of lamination of PP and EVOH, the amount of transmission of oxygen gas is preferably 1.0 to 1974.0 ml/m$^2$/day/MPa, and the thickness of the gas barrier base layer is preferably 15 to 100 μm in view of stiffness of the band tape. The thickness is more preferably 20 to 90 μm, and further preferably 25 to 85 μm.

Adhesion in the present invention means bonding of the band tape, and the receptacle and the lid. Adhesion strength can be appropriately selected, and typical adhesives are of a solvent type, a hot melt type, a reactive type, etc. However, any adhesives can be used, and when the content is a food product, adhesives that comply with the Food Sanitation Law are preferably used. The adhesives include, for example, a rubber adhesive, an acrylic adhesive, a vinyl ether adhesive, a silicone adhesive, or a resin compound that is composed exclusively of at least one of them. In view of ease of setting desired adhesive strength, the rubber adhesive, the acrylic adhesive, and the vinyl ether adhesive are preferable, and the rubber adhesive and the acrylic adhesive are more preferable. In view of reduced solvent extracts and reduced impurities, the acrylic adhesive is further preferable.

The adhesives may contain known additives, for example, an antioxidant, a light stabilizer, an antistatic agent, an anti-fogging agent, or a coloring agent, without compromising the advantage of the present invention. In order to produce partial separation between the gas barrier base layer and the adhesive layer of the adhesive label for gas displacement packaging and sealing, a silicon print having a separation effect is previously made on the gas barrier base layer, and so-called a tampering prevention print may be made in which the adhesive layer is separated from the gas barrier base layer, and remains on the receptacle and the lid to which the adhesive layer adheres.

The rubber adhesive may include, for example, at least one adhesive elastomer selected from a natural rubber exclusively composed of cis-1,4-polyisoprene; a synthetic rubber exclusively composed of a styrene-butadiene rubber (SBR), poly isobutylene, butyl rubber, etc.; or a block rubber exclusively composed of a styrene-butadiene-styrene copolymer rubber (SBS), styrene-isoprene-styrene copolymer rubber (SIS), etc., mixed with an adhesive attaching agent such as a rosin resin, a terpene resin, a petroleum resin, or a chroman-indene resin that is a thermoplastic resin of an amorphous oligomer (middle molecule weight copolymer more than a dimmer) having a molecular weight of some hundreds to about ten thousands in liquid or solid at room temperature, and a softener such as mineral oil, liquid polybutene, liquid polyisobutylene, liquid polyacrylic ester, etc.

The acrylic adhesive may include, for example, an adhesive reactant of a main monomer that provides adhesion such as acrylic acid alkyl ester that is a homopolymer generally with low Tg; a comonomer that can be copolymerized with the main monomer and provide cohesiveness to increase Tg, such as acrylic acid ester of a lower alkyl group, methacrylic acid alkyl ester, vinyl acetate, styrene, acrylonitrile; a monomer containing a carboxyl group such as acrylic acid or methacrylic acid (acrylate etc.); and a monomer containing a functional group that provides adhesion and becomes a crosslinking point such as a hydroxyl group, an epoxy group, or an amino group, mixed with the adhesive attaching agent, the softener, etc. in some cases.

The vinyl ether adhesive may include, for example, a homopolymer such as vinyl methyl ether, vinyl ethyl ether, or vinyl isobutyl ether, or a copolymer (an adhesive elastomer) with acrylate, mixed with the adhesive attaching agent, the softener, etc. in some cases.

The silicone adhesive may include, for example, a polymer (or an adhesive elastomer) having a residual silanol group (SiOH) at a terminal of a polymer chain such as polydimethyl siloxane or polydimethyl diphenyl siloxane with a high molecule weight, mixed with the adhesive attaching agent, the softener, etc.

The synthetic rubber adhesive or the acrylic adhesive are preferable because the adhesive strength can be set in a wide range in view of the gas barrier property, especially the gas displacement packaging, and in view of food sanitation.

The adhesive strength is preferably 0.1 to 15 N/cm in a measuring method by a 180 degrees peeling test of JIS-Z-0237 in view of adhesive strength in adhesion and peeling strength in peeling. The adhesive strength is more preferably 0.2 to 13 N/cm, and further preferably 0.3 to 12 N/cm.

The thickness of the adhesive layer differs depending on adhesives to be used, but the adhesive strength may be 0.1 to 15 N/cm and does not depend on the thickness of the adhesive layer. For example, in the case of the rubber adhesive or the acrylic adhesive, the thickness of the adhesive layer is preferably 3 to 70 μm in view of the adhesive strength. The thickness is more preferably 5 to 60 μm, and further preferably 8 to 55 μm.

The band tape preferably has a certain degree of strength and elongation in view of mechanical suitability when the tape is attached by a machine. In a measurement based on an adhesive tape test of JIS-Z-0237, tensile strength is preferably 10 to 120 N/10 mm, more preferably 20 to 110 N/10 mm, and further preferably 25 to 95 N/10 mm. The band tape itself preferably has flexibility in order for the band tape to be adhered to the corners of the receptacle and the lid without any gas dispersion area (clearance) such as wrinkles. In an elasticity measurement of a 100 mm long band tape (10 mm wide) under a condition of tensile rate of 5 mm/min, the elasticity is 3 to 150 kg/mm$^2$, more preferably 5 to 130 kg/mm$^2$, further preferably 7 to 110 kg/mm$^2$, in view of an adhesion state of the band tape to the receptacle and the lid.

Figure 15A:
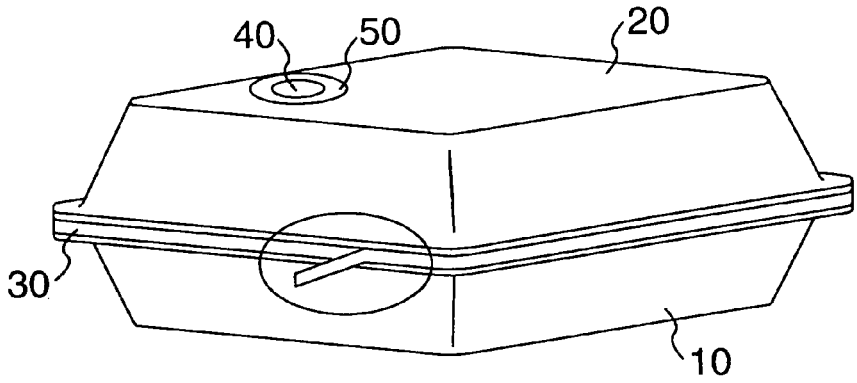
FIG. 15*a* is a perspective view in which the overlapped ridges of the receptacle and the lid are sealed with the band tape in a clockwise direction, and sealing has been completed with an end of the band tape being not adhered to the receptacle and the lid.
Figure 15C:
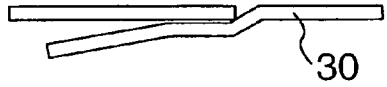
FIG. 15*c* is a schematic diagram of ends of the band tape in FIG. 15*a* overlapped each other, seen from the above.

Further, in the case where the band tape is attached to the packaging container to seal the entire periphery, seal is realized by overlapping the band tape once wound around the packaging container on a front end thereof (FIG. 15*c*).

When the band tape once wound around the packaging container is overlapped on the front end of the band tape, a slight clearance is sometimes created along the width of the band tape depending on the thickness of the front end of the band tape. To fill the clearance, sealing performance may be increased by smoothing the band tape with a spatula to move the adhesive layer, or covering the band tape with a hot melt agent, or various gas barrier films.

Figure 16A:
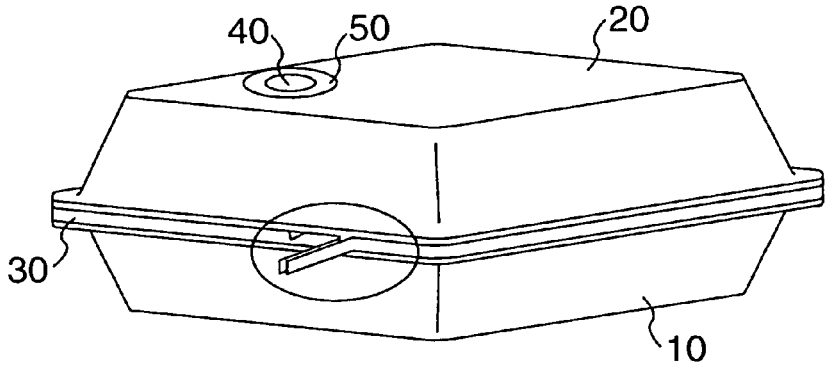
FIGS. 16*a*, 16*b* and 16*c* show an example in which the same receptacle and the lid as shown in FIGS. 15*a*, 15*b* and 15*c* are used and a cutout is formed at a side along the length of the band tape.
Figure 17A:
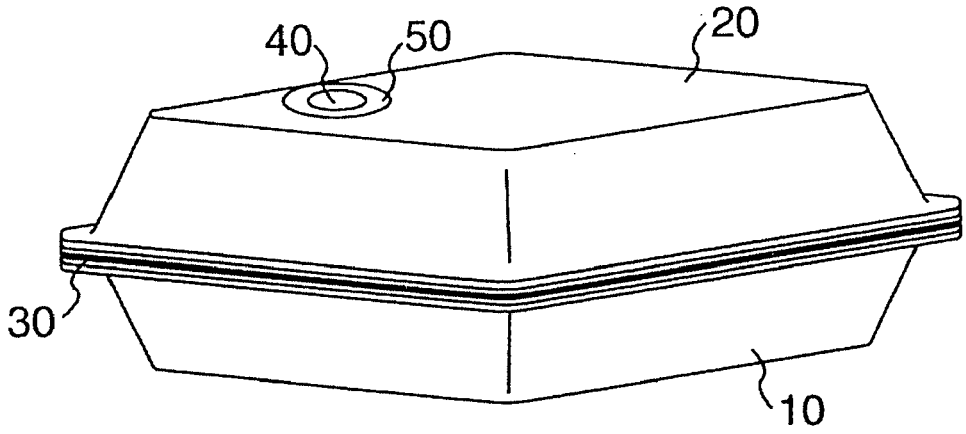
FIGS. 17*a* and 17*b* show an example in which the same receptacle and the lid as shown in FIGS. 15*a*, 15*b* and 15*c* are used and a cut tape is provided in parallel with the length of the band tape and at the center of the width of the band tape.
Figure 17B:
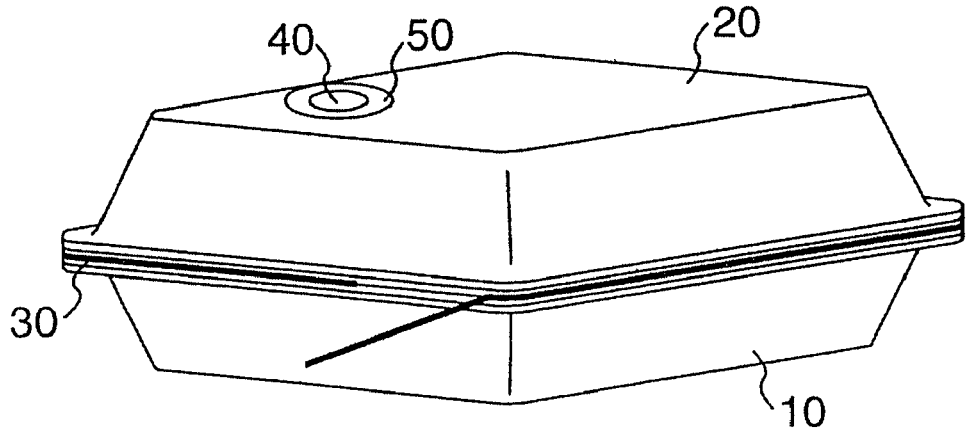

The band tape 30 may have a function of easy opening. For example, the band tape is provided with a narrow portion such as a cutout (FIG. 16*a*). Upon opening, the band tape is broken at the narrow portion. Alternatively, the band tape is provided with a string-like cut tape in parallel with the length of the band tape at a center of the width of the band tape (FIG. 17*b*). Upon opening, the band tape sealing the flanges of the receptacle and the lid is separated into two at the center by the cut tape (upper and lower ends of the separated band tape are still attached to the receptacle and the lid) to easily open the package. With these structure, the packaging container can be easily opened.

The adhesive label will be described. The adhesive label preferably contains a gas barrier material. The hole is closed by the label to seal so as to prevent a desired gas in the packaging container from being dispersed. Thus, the adhesive label requires tight contact with the receptacle and the lid. The adhesive label may only require tight contact, which may be any of sealing, bonding, or adhesion.

The adhesive strength of the adhesive label may be appropriately selected, and the kind or the amount of application of the adhesive may be selected depending on desired adhesive strength. The same adhesives as used for the band tape may be used, but for use of cooking by a microwave oven, an adhesive label using an adhesive of the water or organic solvent type or the hot melt type that has a tendency to reduce the adhesive strength with increase in temperature in the packaging container is preferable in view of preventing water vapor blowout caused by increase in internal pressure of the packaging container resulting from heating by the microwave oven. The adhesive of the water or organic solvent type or the hot melt type are more preferable since they have safety in food sanitation. The adhesive label can have any shapes as long as it can close the hole, regardless of opening shape of the hole. For example, the shapes may include a square (A in FIG. 8), a rectangle (B in FIG. 8), a rounded rectangle (C in FIG. 8), a polygon (D in FIG. 8), a circle (E in FIG. 8), a semi-circle (F in FIG. 8), an ellipse (G in FIG. 8), a semi-ellipse (H in FIG. 8), a star (I in FIG. 8), and an indefinite shape (J in FIG. 8), and a circle (K in FIG. 8), a rectangle (L in FIG. 8), and an ellipse (I in FIG. 8) with a tab. For the lid made of the resin sheet, uneven portions may be created near the hole to increase stiffness of the lid when the adhesive label is attached.

Materials of the adhesive label may include a single layer or a multilayer of paper, metal thin films, or resin, but materials including metal such as a metal thin film or a metallized film are not preferable in view of preventing spark caused by electron collision in heating by a microwave oven, and the same material as the packaging container is preferable in view of fractional recovery. A gas barrier resin is further preferable in order to prevent gas dispersion.

The material having the gas barrier property, the configuration, the thickness, and the performance may be the same as described above with respect to the band tape.

The adhesive strength of the adhesive tape is preferably 0.1 to 10 N/cm in a measuring method by a 180 degrees peeling test at 25° C. of JIS-Z-0237 (the 180 degrees peeling test of JIS-Z-0237: a 25 mm wide tape is attached to a stainless plate, one end of the tape is peeled off from the test plate toward the other end in a 180 degrees direction at a peeling rate of 300 m/min, and a force required for the peeling is measured and used), in view of the adhesive strength upon adhesion and the peeling strength upon peeling. The adhesive strength is preferably 0.2 to 9.5 N/cm, and more preferably 0.3 to 7.5 N/cm. A measured value by the 180 degrees peeling test at 80° C. is preferably lower than a measured value by the 180 degrees peeling test at 25° C. in view of the adhesive label automatically peeling off by the increase in the internal pressure of the packaging container. The measured value by the 180 degrees peeling test at 25° C. is preferably 0.1 to 8 N/cm in view of the adhesive strength upon adhesion and the peeling strength upon peeling. The measured value is more preferably 0.2 to 7.5 N/cm, and further preferably 0.3 to 5.5 N/cm.

The thickness of the adhesive layer differs depending on the adhesives to be used, but the adhesive strength may be 0.1 to 10 N/cm in the measuring method by the 180 degrees peeling test at 25° C., and does not depend on the thickness of the adhesive layer. For example, in the case of the rubber adhesive or the acrylic adhesive, the thickness of the adhesive layer is preferably 2 to 10 μm in view of the adhesive strength. The thickness is more preferably 3 to 90 μm, and further preferably 5 to 85 μm.

The gas barrier adhesive label has a certain degree of strength in view of preventing breakage caused by external puncture. In a measurement based on Article 10 of the Japan Agriculture Standard, puncture strength is preferably 2.0 N and more, more preferably 2.5 N and more, and further preferably 3.0 N and more. Further, the adhesive label may have a tab for ease of opening. For example, it is preferable in view of prevention of blowout in heating the packaging container that the adhesive label has a semi-circular tab which is pulled up from the lid to easily open the packaging container for ease of opening.

Main contents of the packaging container are cooked food products, for example, delis (boiled, baked, steamed, or fried foods) or boxed meals sold at supermarkets or convenience stores.

Now, a packaging method according to the present invention will be described.

The packaging method according to the present invention is a gas displacement sealing method in which the hole 40 is used to perform deaeration and gas displacement in a chamber, and the hole is closed after the gas displacement. Thus, gas in a space or the content in the packaging container is displaced by a desired gas. Specifically, after deaerating the chamber, gas displacement is performed by an inert gas, thereby causing deaeration and gas displacement in the packaging container via the hole provided on the container. The deaeration and the gas displacement in the chamber substantially eliminate a difference in atmospheric pressures between the inside of the packaging container and the inside of the chamber (the outside of the packaging container) to prevent the packaging container from being crushed by the difference in the atmospheric pressures.

The gas displacement means that air in the packaging container is displaced by a desired gas, which contributes to increase in shelf life of the contents and to prevent color variation of the product. For example, holding food products in an inert gas atmosphere contributes to (1) preventing oxidation of oil and fat content, (2) preserving active ingredients such as vitamins, (3) preventing rot caused by development of mold, bacteria, or yeast, (4) preventing discoloration and fading, and (5) preventing loss of flavor, etc.

Further, displacement by a gas such as carbon dioxide having bacteriostasis can sometimes increase the shelf life of the contents.

Any gases generally known can be used in the present invention. For example, nitrogen, carbon dioxide, oxygen, argon, etc. can be used alone or in combination thereof. Ozone or natural and synthetic antibacterial substances (for example, hinokitiol) generally known as bactericide for mold, bacteria, or yeast may be used.

Figure 9A:
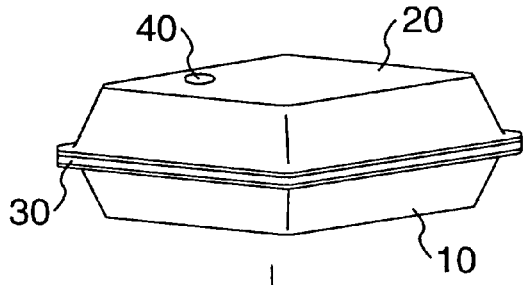
FIGS. 9*a*, 9*b* and 9*c* are perspective views of a gas displacement method according to the present invention.
Figure 9B:
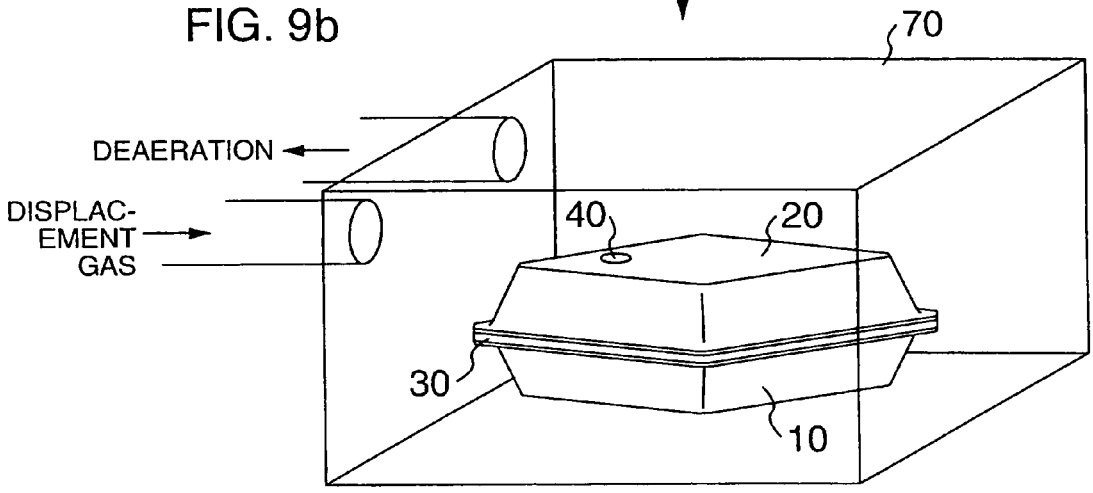
Figure 9C:
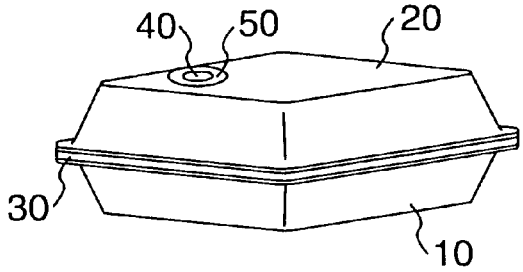

As a method of deaeration and gas displacement in the chamber, a general chamber type gas displacement method can be used. Generally known gas displacement methods are of the chamber type and the gas flushing type. FIGS. 9*a*, 9*b* and 9*c* show a chamber type gas displacement method according to the present invention. The chamber type gas displacement method according to the present invention is a method in which the packaging container, of which the receptacle 10 and the lid 20 (hole 40) are sealed with the band tape 30, is placed in the space in the chamber (reference numeral 70 in FIG. 9*b*), the whole of the air in the chamber is expelled to be vacuum once (FIG. 9*b*), and then a desired gas is fed into the chamber under vacuum for gas displacement. The adhesive label 50 is attached to the hole 40 of the lid 20 in the chamber to seal the space in the packaging container (FIG. 9*c*).

Generally, the chamber type gas displacement method can provide a high rate of gas displacement and reliable gas displacement, while the gas flushing type gas displacement method tends to provide a low rate of gas displacement though it is simple and inexpensive. The gas displacement method according to the present invention is of the chamber type described above, and the air in the space and the contents in the packaging container is reliably displaced by gas to increase the shelf life of the content and to prevent discoloration of the product, thereby allowing displacement in the packaging container at the high rate.

Figure 10:
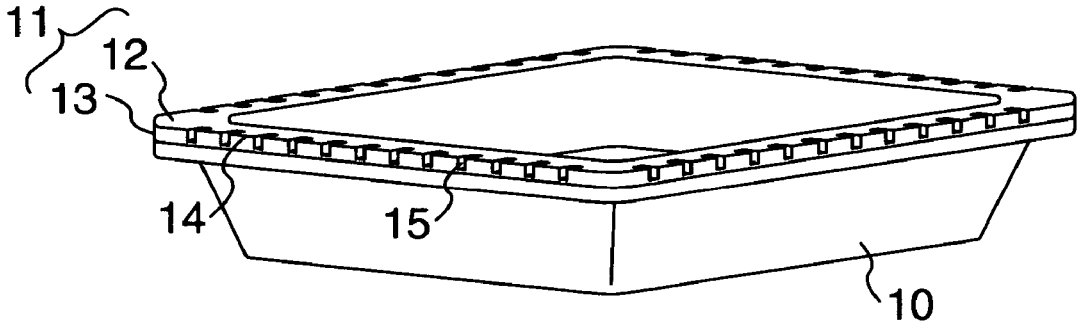
FIG. 10 is a perspective view of a receptacle used in the examples.
Figure 11:
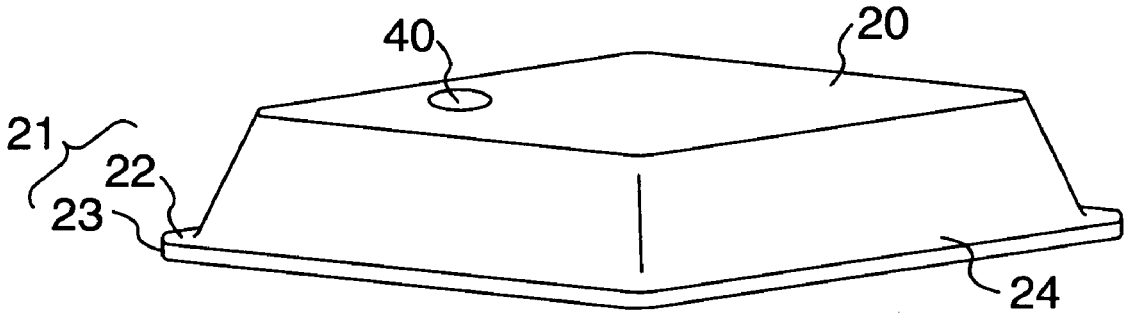
FIG. 11 is a perspective view of a lid used in the examples.
Figure 12:
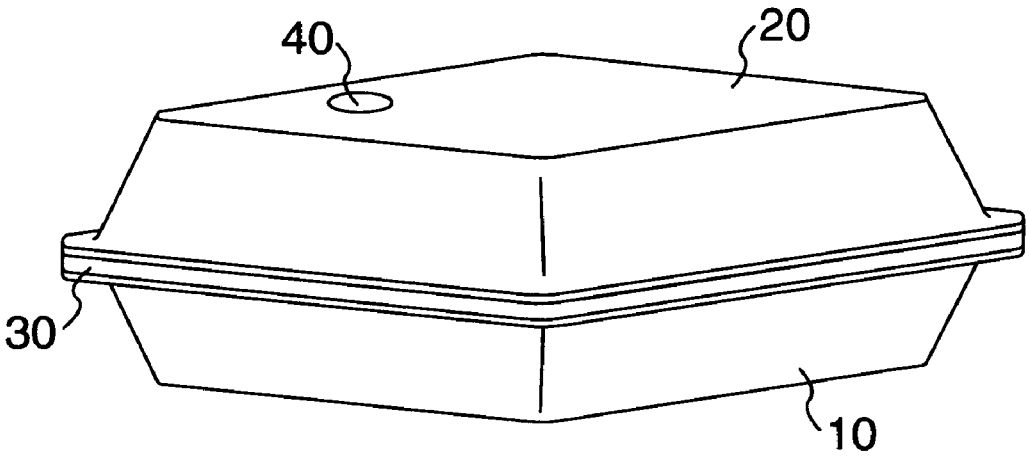
FIG. 12 is a perspective view of the receptacle and the lid used in the examples overlapped each other.
Figure 13:
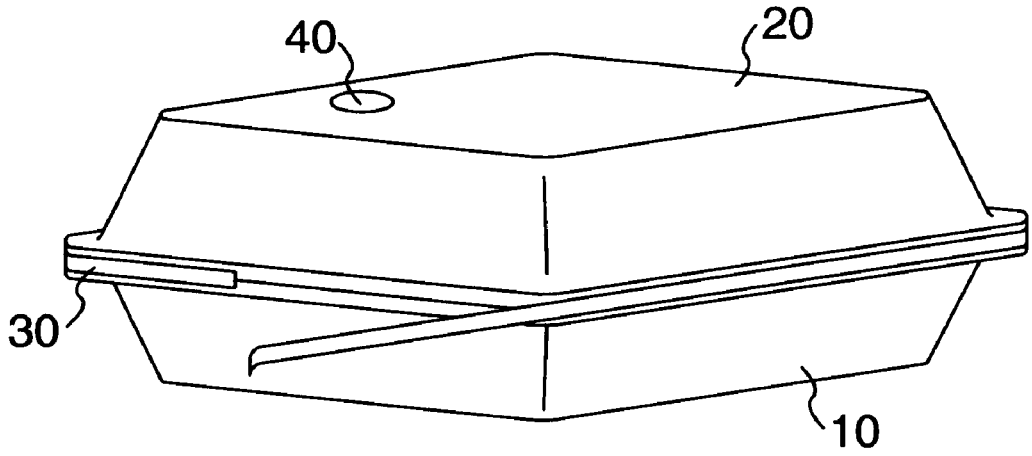
FIG. 13 is a perspective view of sealing with a band tape in the examples.
Figure 14:
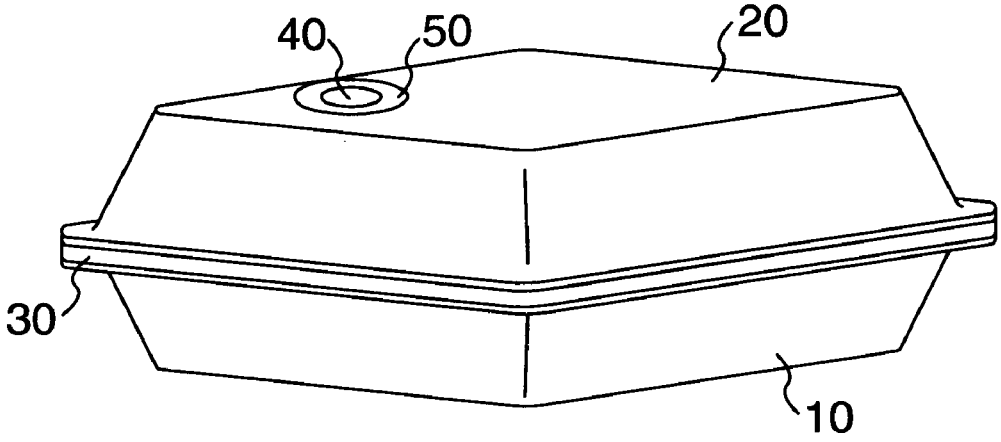
FIG. 14 is a perspective view in which the ridges of the receptacle and the lid are overlapped and sealed with the band tape.

An example of a sealing method of sealing a packaging container comprising the receptacle and the lid with a band tape according to the present invention will be described with reference to the drawings. A rectangular receptacle (FIG. 10) and a lid (FIG. 11) are used and ridges of the receptacle and the lid (FIG. 12) overlap each other, and the ridges are sealed with the band tape (FIG. 13). FIG. 13 is a perspective view showing a state in which the overlapping ridges of the receptacle and the lid are being sealed in a clockwise direction with the band tape. FIG. 14 is a perspective view showing a state in which the overlapping ridges of the receptacle and the lid have been sealed with the band tape. The bonding direction of the band tape may be in the clockwise direction as shown or in the counterclockwise direction, as long as the overlapping ridges of the receptacle and the lid can be sealed with the band tape. As described above, the receptacle and the lid are sealed with the band tape, therefore receptacles and lids of any shapes can be sealed with the band tape. Thus, this sealing method is excellent.

An example of ease of opening will be described with reference to FIGS. 15*a*, 15*b*, 15*c*, 16*a*, 16*b*, 16*c*, 17*a* and 17*b*. FIGS. 15*a*, 15*b*, 15*c*, 16*a*, 16*b*, 16*c*, 17*a* and 17*b* show a process of causing only the ridges of the rectangular receptacle and lid to overlap each other, and sealing the receptacle and the lid with the band tape having adhesion. The band tape in FIGS. 15*a*, 15*b*, 15*c*, 16*a*, 16*b*, 16*c*, 17*a* and 17*b* is attached so as to achieve the ease of opening, or the band tape itself is formed to achieve the ease of opening.

Figure 15B:
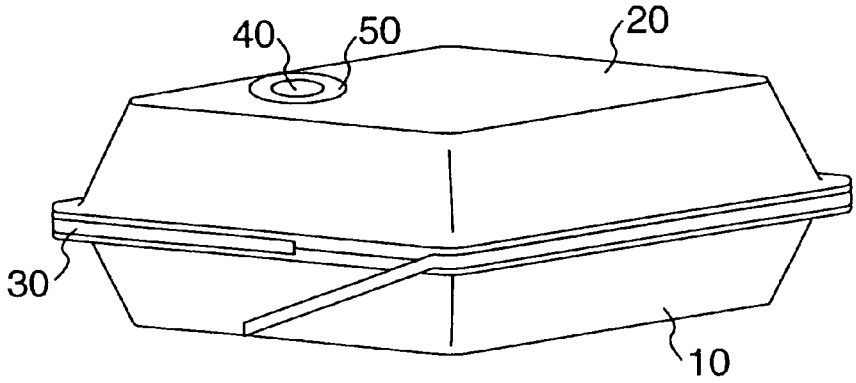
FIG. 15*b* is a perspective view in which the end of the band tape not adhered to the receptacle and the lid is being pulled for unsealing.
Figure 16C:
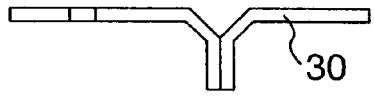
Figure 16B:
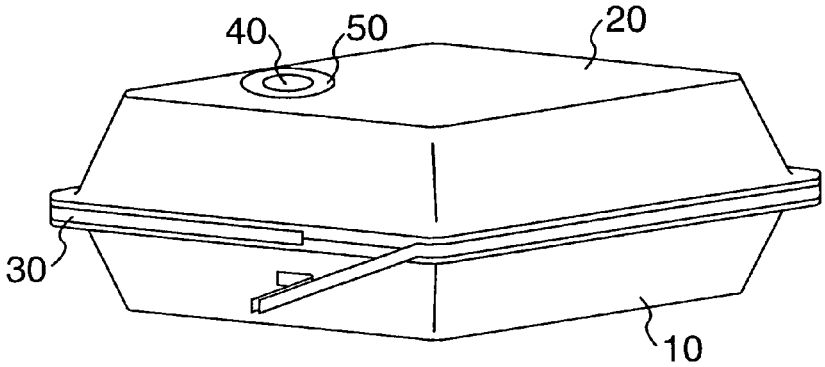

Examples shown in FIGS. 15*a*, 15*b*, 15*c*, 16*a*, 16*b*, 16*c*, 17*a* and 17*b* will be described in detail. FIG. 15*a* is a perspective view showing a state in which the overlapping ridges of the rectangular receptacle and lid are sealed in the clockwise direction with the band tape, and sealing has been completed with a rear end of the band tape being not adhered to the receptacle and the lid. FIG. 15*b* is a perspective view showing a state in which the rear end of the band tape not adhered to the receptacle and the lid is being pulled for opening. FIG. 15*c* is a schematic diagram of ends of the band tape in FIG. 15*a* overlapping each other, seen from the above. As methods for giving no adhesive only to the rear end of the tape as described above, there are a method in which a circumferential dimension of the packaging container is previously measured, and only an overlapping portion of the tape is not coated with an adhesive, and a method in which a band tape across which an adhesive is applied is used, and adhesive surfaces at the rear end of the tape only are attached to each other. The latter method is simple and preferable. FIGS. 16*a*, 16*b* and 16*c* show an example in which the same receptacle and the lid as the example shown in FIGS. 15*a*, 15*b* and 15*c* are used and a cutout at a side along the length of the band tape is provided. Like the example shown in FIGS. 15*a*, 15*b* and 15*c*, FIG. 16*a* is a perspective view showing a state in which the band tape with the cutout is used, and sealing has been completed. FIG. 16*b* is a perspective view showing a state in which the rear end of the band tape is being pulled to cause breakage at the cutout of the band tape for opening. FIG. 16*c* is a schematic diagram of the ends of the band tape in FIG. 16*a*, seen from the above. As described above, pulling the rear end causes the band tape to be cut from the cutout near the rear end of the band tape, thereby facilitating opening. The cutout of the band tape may be created at part of the side of the band tape as shown in FIGS. 16*a*, 16*b* and 16*c*, or may be created across the side or at both sides as long as the tape is cut when pulled. FIGS. 17*a* and 17*b* show an example in which the same receptacle and the lid as shown in FIGS. 15*a*, 15*b* and 15*c* are used and a cut tape is provided in parallel with the length of the band tape at the center along the width of the band tape. Like FIGS. 15*a*, 15*b* and 15*c*, FIG. 17*a* is a perspective view showing a state in which the band tape with the cut tape 60 in parallel with the length is used, and sealing has been completed. FIG. 17*b* is a perspective view showing a state in which a rear end of the cut tape of the band tape with the cut tape in parallel with the length is being pulled to separate the band tape into two at the center by the cut tape (upper and lower ends of the separated band tape are still attached to the receptacle and the lid) for opening the packaging container. The method in which the cut tape is provide in parallel with the length of the band tape at the center of the width of the band tape, and the band tape sealing the ridges of the receptacle and the lid is separated into two at the center by the cut tape to easily open the packaging container is preferable in view of ease of opening. A color of the cut tape may be differed from a color of the band tape for clarity.

Now, measuring methods and examples will be described in detail.

(1) Measuring an Amount of Transmission of Oxygen Gas

An amount of transmission of oxygen gas was measured in accordance with ASTM-D-3985 (at a measurement temperature of 23° C.).

(2) Measuring a Percentage of Oxygen Composition in a Space in a Packaging Container A percentage of oxygen composition in a space in a packaging container at 23° C. and 50% RH was measured using Checkpoint manufactured by PBI-Dansensor A/S.

G(good): The percentage of oxygen composition in the space in the packaging container after ten days is less than 1%.

M(moderate): The percentage of oxygen composition in the space in the packaging container after ten days is 1% or more and less than 2%.

P(poor): The percentage of oxygen composition in the space in the packaging container after ten days is 2% or more.

(3) Cooking Hamburgers

Minced beef and pork (5:5) of 1 kg and 2 middle size eggs were kneaded to become viscous while being cooled to 5° C. or less, and then 0.3 kg fried onion and 0.12 kg bread crumbs were added and further kneaded. The kneaded materials were divided into 120 g portions, shaped into an oval shape, placed in a 120° C. oven and heated until a central temperature reaches 70° C. to cook hamburgers.

(4) Measuring a Preservation Temperature

A temperature was measured for every 10 minutes using Button Type Cool Memory manufactured by Sanyo Electric Co., Ltd. A cooked food product was packaged, and then preserved in Open Showcase EA-MS manufactured by Mitsubishi Electric Corporation (at a preservation temperature of 15° C.).

(5) Measuring General Viable Cell Count

A hamburger of 1 g was successively diluted with up to ten parts of water, and diluted sample solutions were prepared. Two deep petri dishes were provided for each dilution stage, and each diluted sample solution was poured into each dish by 1 ml. A standard agar medium of 15 ml that is previously subjected to high pressure steam sterilization and then held at about 45° C. was aseptically poured into each dish, calmly mixed such that the diluted sample solution and the medium immediately mixed well, and calmly left until the medium completely solidified. The operation from pouring the diluted sample solution into the dish to mixing with the medium was finished within 20 minutes, and when the medium solidified, the dish was inverted, a surface of the medium was dried for 30 minutes in an incubator to perform cultivation at 35° C. for 48 hours. Then, the number of development colonies on a plate in which 30 to 300 cells developed was measured, the numbers of colonies on two plates were averaged and multiplied by multiples of dilution to determine viable cell count for the food product of 1 g.

EXAMPLES 1 TO 6

An undrawn barrier multilayer film was attached to a polypropylene resin sheet with filler for a receptacle, and a polystyrene resin sheet for a lid, using a polyurethane dry laminate adhesive to form a multilayer resin sheet. The multilayer resin sheet was thermoformed into shapes shown in FIGS. 10 (the receptacle), 11 (the lid), and 12 (the lid placed on the receptacle). The lid was formed with a C-shaped hole having a 25 cm diameter on a top thereof by a punch after forming and before drawing a formed product. Substantially vertical flanges of the receptacle and the lid were sealed with a band tape shown in the examples. The volume in a packaging container was 800 $cm^3$. The packaging container is subjected to vacuum and gas displacement using a chamber, air in the packaging container was displaced by a high purity nitrogen gas (purity 99.99%), the C-shaped hole on the lid was sealed with a circular adhesive label having a 35 cm diameter shown in the examples, and then, gas composition in the packaging container was measured immediately after sealing, one day after the sealing, and 10 days after the sealing. The conditions and results will be shown in Table 1. Further, a hamburger as an example of a food product was placed in the packaging container with the volume of 800 $cm^3$ used in the examples of the packaging container, and a mixed gas of carbon dioxide and nitrogen (1:1) was used to perform vacuum type gas displacement packaging. Some samples prepared as described above were provided and preserved for a week at various temperatures to determine general viable cell count at certain times. The general viable cell count was determined for random samples selected from some samples provided under the same conditions. The conditions and the results will be shown in Table 1.

COMPARATIVE EXAMPLE 1

The same experiment as the examples was conducted except for using a polypropylene resin sheet with filler for the receptacle, and a polystyrene resin sheet for the lid. The conditions and the results will be shown in Table 1.

According to the present invention, the gas displacement is performed after the deaeration in the chamber, thus the air in the space and the content in the packaging container can be displaced by gas at a high rate of displacement in comparison with the gas flush type gas displacement method. Seal packaging requires no heat-shrinkable film, thus reducing the number of packaging materials to be used, and entrepreneur's bearing of cost based on the Container and Package Recycling Law. Further, the overlapping ridges of the receptacle and the lid can be sealed with the band tape to enclose the packaging container, so that even if the shape or the size of the packaging containers changes when performing packaging by using a device, a height of the band tape may be only adjusted to match a height of the overlapping ridges of the receptacle and the lid. There is no need for selecting materials for the plastic package, and opening is extremely easy.

TABLE 1

| | | Example 1 | Example 2 | Example 3 | Example 4 | Example 5 | Example 6 | Comparative example 1 |
|---|---|---|---|---|---|---|---|---|
| Multilayer film | | | | | | | | |
| Layer configuration | Outermost layer Thickness (μm) | PP Coextrusion 7 | NY Coextrusion 5 | NY Coextrusion 5 | NY Coextrusion 5 | NY Coextrusion 5 | PP Coextrusion 7 | |
| | Internal layer Thickness (μm) | Adhesive layer Coextrusion 5 | EVOH Coextrusion 5 | EVOH Coextrusion 5 | EVOH Coextrusion 5 | EVOH Coextrusion 5 | Adhesive layer Coextrusion 5 | |
| | Internal layer Thickness (μm) | EVOH Coextrusion | NY Coextrusion | NY Coextrusion | NY Coextrusion | NY Coextrusion | EVOH Coextrusion | |

TABLE 1-continued

| | | Example 1 | Example 2 | Example 3 | Example 4 | Example 5 | Example 6 | Comparative example 1 |
|---|---|---|---|---|---|---|---|---|
| | | 6 | 5 | 5 | 5 | 5 | 6 | |
| | Internal layer | Adhesive layer | Adhesive layer | Adhesive layer | Adhesive layer | Adhesive layer | Adhesive layer | |
| | Thickness (μm) | Coextrusion | Coextrusion | Coextrusion | Coextrusion | Coextrusion | Coextrusion | |
| | | 5 | 5 | 5 | 5 | 5 | 5 | |
| | Internal layer | PP | PP | PS | LL | EVA | PP | |
| | (laminate surface) Thickness (μm) | Coextrusion 7 | Coextrusion 30 | Coextrusion 30 | Coextrusion 30 | Coextrusion 30 | Coextrusion 7 | |
| Thickness of multilayer film (μm) | | 30 | 50 | 50 | 50 | 50 | 30 | |
| Adhesive layer (dry laminate) | | Urethane | Urethane | Urethane | Urethane | Urethane | Urethane | |
| Thickness (μm) | | 5 | 5 | 5 | 5 | 5 | 5 | |
| Resin sheet for container | | PP filler | PP filler | PP filler | PP filler | PP filler | PP filler | PP filler |
| Draw ratio Length to width | | Undrawn | Undrawn | Undrawn | Undrawn | Undrawn | Undrawn | Undrawn |
| Thickness (μm) | | 450 | 450 | 450 | 450 | 450 | 450 | 450 |
| 02TR ml/m$^2$/D/MPa | | Less than 10 | Less than 10 | Less than 10 | Less than 10 | Less than 10 | Less than 10 | 5000 or more |
| Multilayer film | | | | | | | | |
| Layer configuration | Outermost layer Thickness (μm) | PP Coextrusion 7 | NY Coextrusion 5 | NY Coextrusion 5 | NY Coextrusion 5 | NY Coextrusion 5 | NY Coextrusion 5 | |
| | Internal layer | Adhesive layer | EVOH | EVOH | EVOH | EVOH | EVOH | |
| | Thickness (μm) | Coextrusion | Coextrusion | Coextrusion | Coextrusion | Coextrusion | Coextrusion | |
| | | 5 | 5 | 5 | 5 | 5 | 5 | |
| | Internal layer | EVOH | NY | NY | NY | NY | NY | |
| | Thickness (μm) | Coextrusion | Coextrusion | Coextrusion | Coextrusion | Coextrusion | Coextrusion | |
| | | 6 | 5 | 5 | 5 | 5 | 5 | |
| | Internal layer | Adhesive layer | Adhesive layer | Adhesive layer | Adhesive layer | Adhesive layer | Adhesive layer | |
| | Thickness (μm) | Coextrusion | Coextrusion | Coextrusion | Coextrusion | Coextrusion | Coextrusion | |
| | | 5 | 5 | 5 | 5 | 5 | 5 | |
| | Internal layer | PP | PP | PS | LL | EVA | EVA | |
| | (laminate surface) Thickness (μm) | Coextrusion 7 | Coextrusion 30 | Coextrusion 30 | Coextrusion 30 | Coextrusion 30 | Coextrusion 30 | |
| Thickness of multilayer film (μm) | | 30 | 50 | 50 | 50 | 50 | 50 | |
| Adhesive layer (dry laminate) | | Urethane | Urethane | Urethane | Urethane | Urethane | Urethane | |
| Thickness (μm) | | 5 | 5 | 5 | 5 | 5 | 5 | |
| Resin sheet for lid | | OPS | OPS | OPS | OPS | OPS | OPS | OPS |
| Draw ratio Length to width | | 4 × 4 | 4 × 4 | 4 × 4 | 4 × 4 | 4 × 4 | 4 × 4 | 4 × 4 |
| Thickness (μm) | | 250 | 250 | 250 | 250 | 250 | 250 | 250 |
| 02TR ml/m$^2$/D/MPa | | Less than 10 | Less than 10 | Less than 10 | Less than 10 | Less than 10 | Less than 10 | 5000 or more |
| Band tape | Film | NY | NY | PP/EVOH/PP | PP/EVOH/PP | PP/EVOH/PP | PP/EVOH/PP | NY |
| | Thickness (μm) | 30 | 30 | 30 | 30 | 30 | 30 | 30 |
| | Adhesive | Acrylic | Synthetic | Acrylic | Synthetic | Acrylic | Synthetic | Acrylic |
| | Amount of coating (g/m$^3$) | 25 | rubber 25 | 25 | rubber 25 | 25 | rubber 25 | 25 |
| Adhesive label | Film | PET | PET | PET | PET | PET | PET | PET |
| | Thickness (μm) | 75 | 50 | 75 | 50 | 75 | 75 | 75 |
| | Adhesive | | | | | | | |
| | Amount of coating (g/m$^3$) | Acrylic 25 | Acrylic 25 | Acrylic 25 | Acrylic 25 | Acrylic 25 | Acrylic 25 | Acrylic 25 |
| Concentration of oxygen in package | Immediately after sealing | G | G | G | G | G | G | G |
| | One day later | G | G | G | G | G | G | M |
| | Ten days later | G | G | G | G | G | G | P |
| General viable cell count | Immediately after | $1.1 \times 10^1$ | $1.1 \times 10^1$ | $1.1 \times 10^1$ | $1.1 \times 10^1$ | $1.1 \times 10^1$ | $1.1 \times 10^1$ | $1.1 \times 10^1$ |
| | One day later | $4.4 \times 10^1$ | $4.3 \times 10^1$ | $7.4 \times 10^1$ | $2.4 \times 10^1$ | $3.4 \times 10^1$ | $2.4 \times 10^1$ | $6.4 \times 10^5$ |
| | Three days later | $3.2 \times 10^2$ | $2.2 \times 10^2$ | $3.8 \times 10^2$ | $3.2 \times 10^2$ | $3.5 \times 10^2$ | $3.6 \times 10^2$ | $2.2 \times 10^7$ |
| | Seven days later | $6.2 \times 10^1$ | $6.1 \times 10^4$ | $5.9 \times 10^4$ | $4.5 \times 10^4$ | $5.3 \times 10^4$ | $5.2 \times 10^4$ | $8.3 \times 10^9$ |

PP: Propylene resin
NY: Nylon resin
EVOH: Ethylene-vinyl acetate copolymer saponified resin
LL: Linear polyethylene resin
EVA: Ethylene-vinyl acetate copolymer resin
Adhesive layer: Maleic acid modified polyolefin resin
PS: Polystyrene resin

The invention claimed is:

1. A method of manufacturing a gas displacement package containing food and gas other than air comprising the steps of:

providing a container comprising a receptacle having an edge portion and a lid having an edge portion, wherein the edge portion of the receptacle overlaps with the edge portion of the lid so that the lid can cover a top of the receptacle, overlapped edge portions of the edge portion of the receptacle and the edge portion of the lid are sealed with an adhesive band tape, the container has a hole having an opening area of 0.3 to 3 $cm^2$ with respect to a volume of the content of 1000 $cm^3$ in the container, and the container contains air and food therein;

expelling the air in the container through the hole so that the air can be displaced by and replaced with gas other than air;

closing sealingly the hole with an adhesive label; and obtaining said gas displacement package containing food and the gas.

2. The method of manufacturing a gas displacement package as claimed in claim 1, wherein the container is made of plastic.

3. The method of manufacturing a gas displacement package as claimed in claim 1, wherein the container, the band tape and the adhesive label have a gas barrier property.

4. The method of manufacturing a gas displacement package as claimed in claim 1, wherein each of the receptacle and the lid has, at the edge portion, a flange including a horizontal portion horizontally extending from a opening, a substantial vertical portion vertically extending from an end of the horizontal portion and a ridge at a boundary between the horizontal portion and the vertical portion, among the vertical portions of the flanges, a vertical portion located inside with respect to the container is longer than a vertical portion located outside with respect to the container, the inside vertical portion has a step at a portion in contact with an end of the outside vertical portion, and the band tape is adhered over the step for sealing.

5. The method of manufacturing a gas displacement package as claimed in claim 4, wherein the vertical portion of the flange vertically extends downwardly from the horizontal portion.

6. The method of manufacturing a gas displacement package as claimed in claim 1, wherein the hole for gas displacement is provided on a top surface of the lid.

7. A package obtained by the method of manufacturing a gas displacement package accord to any one of claims 1–5.

8. The method of manufacturing a gas displacement package as claimed in claim 1, wherein the container is obtained by thermoforming a resin sheet.

9. The method of manufacturing a gas displacement package as claimed in claim 1, wherein the receptacle of the container has recesses at the flange thereof.

10. The method of manufacturing a gas displacement package as claimed in claim 1, wherein the band tape has elasticity of 3–150 $Kg/mm^2$.

11. A method of manufacturing a gas displacement package containing food and gas other than air comprising the steps of:

providing a container comprising a receptacle having an edge portion and a lid having an edge portion, wherein the edge portion of the receptacle overlaps with the edge portion of the lid so that the lid can cover a top of the receptacle, overlapped edge portions of the edge portion of the receptacle and the edge portion of the lid are sealed with an adhesive band tape, the container has a hole having an opening area of 0.3 to 3 $cm^2$ with respect to a volume of the content of 1000 $cm^3$ in the container, and the container contains air therein;

filling the container with food;

expelling the air in the container through the hole so that the air can be displaced by and replaced with gas other than air;

closing sealingly the hole with an adhesive label; and obtaining said gas displacement package containing food and the gas.

* * * * *